United States Patent [19]

Maret et al.

[11] 4,099,581

[45] Jul. 11, 1978

[54] EXPLOSIVE-CARTRIDGE POWERED HAMMER OR IMPACT TOOL

[76] Inventors: Jean Paul Maret, Le Boulevard Karl Marx, Saint-Etienne, France, 42100; Bernard Maret, La Bertrandiere, L'Etrat, France, 42580

[21] Appl. No.: 766,586

[22] Filed: Feb. 8, 1977

[30] Foreign Application Priority Data

Feb. 9, 1976 [FR] France ..... 76 04229

[51] Int. Cl.[2] ..... B25D 9/00

[52] U.S. Cl. ..... 173/133; 60/636; 227/10

[58] Field of Search ..... 173/133, DIG. 2; 60/632, 633, 634, 635, 636, 637, 638; 227/8, 9, 10, 11

[56] References Cited

U.S. PATENT DOCUMENTS

| | | | |
|---|---|---|---|
| 2,680,621 | 6/1954 | Crandall et al. | 24/244 |
| 3,321,018 | 5/1967 | McGill | 166/237 |
| 3,494,125 | 2/1970 | Robinson | 60/636 |
| 3,516,246 | 6/1970 | Butler | 60/636 |
| 3,548,590 | 12/1970 | Mulno | 60/636 |
| 3,744,240 | 7/1973 | Henning et al. | 60/638 |
| 3,863,824 | 2/1975 | Bakoledis | 227/10 |
| 3,918,621 | 11/1975 | Jochum | 227/10 |

*Primary Examiner*—Robert A. Hafer

*Attorney, Agent, or Firm*—Eric P. Schellin; H. Karl Saalbach

[57] ABSTRACT

The application discloses an explosive-cartridge powered hammer or impact tool, which is especially adapted for use in foundries for trimming or finishing castings by knocking off runners, feeder heads and flash, but which can also be used for other operations, such as riveting. The hammer is provided with means to soften recoil.

12 Claims, 8 Drawing Figures

EXPLOSIVE-CARTRIDGE POWERED HAMMER OR IMPACT TOOL

CROSS REFERENCE TO RELATED APPLICATIONS

This application corresponds to the inventor's application No. 76.04229, filed in France on Feb. 9, 1976. The rights of priority under 35 U.S.C. 119 are claimed.

BRIEF SUMMARY

The removal of runners, feeder heads and flash from castings in the foundry presents a number of well known problems.

Frequently, manual labor is used to remove excess metal by striking it off the casting by use of a sledge. This work is laborious and production is low.

Complex machines are also used for the removal of excess metal, but sometimes do not easily remove the excess metal from the casting.

To remedy these drawbacks, the instant invention has been developed. It is an explosive-cartridge powered hammer or impact tool. The device has a cartridge magazine, cartridge feeding device, a breech to receive the cartridge, a hammer to fire the cartridge, a barrel, a massive gas-driven piston on which is mounted an impact head and damping means to soften the recoil of the gun.

VIEWS OF DRAWING

DETAILED DESCRIPTION

Figure 1:
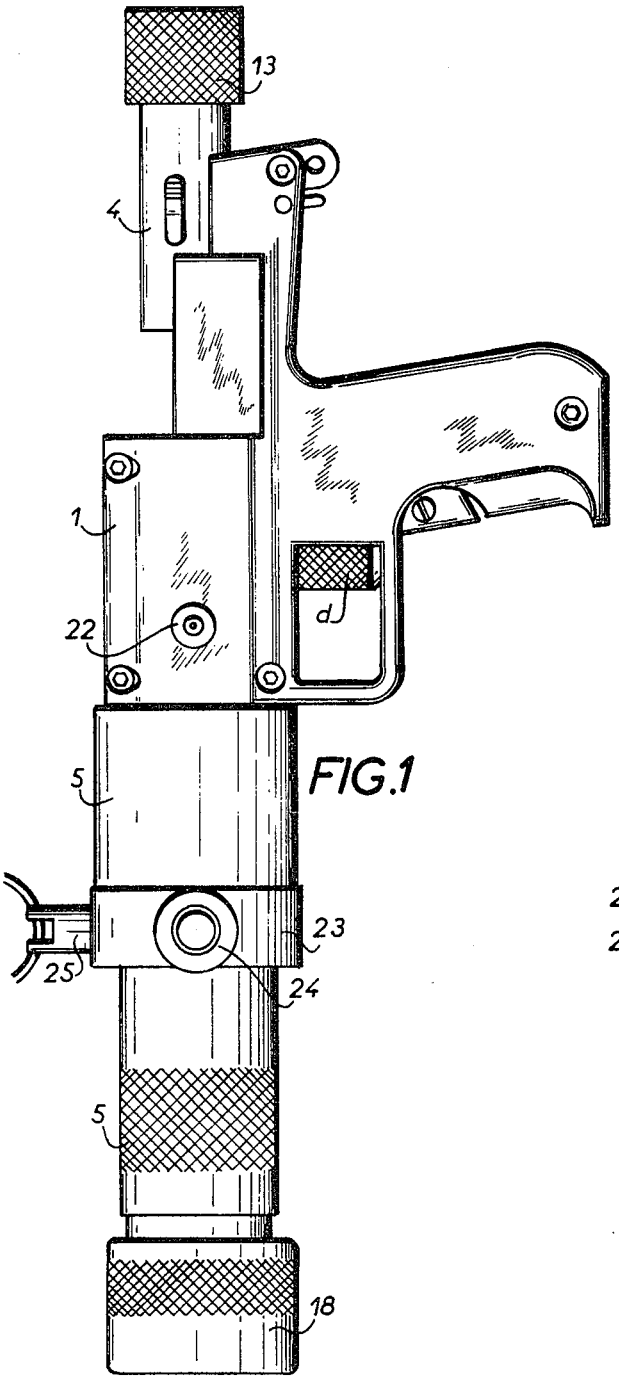
FIG. 1 is a small scale external side view of an explosive-powered hammer or impact device, in accordance with the invention.
Figure 2:
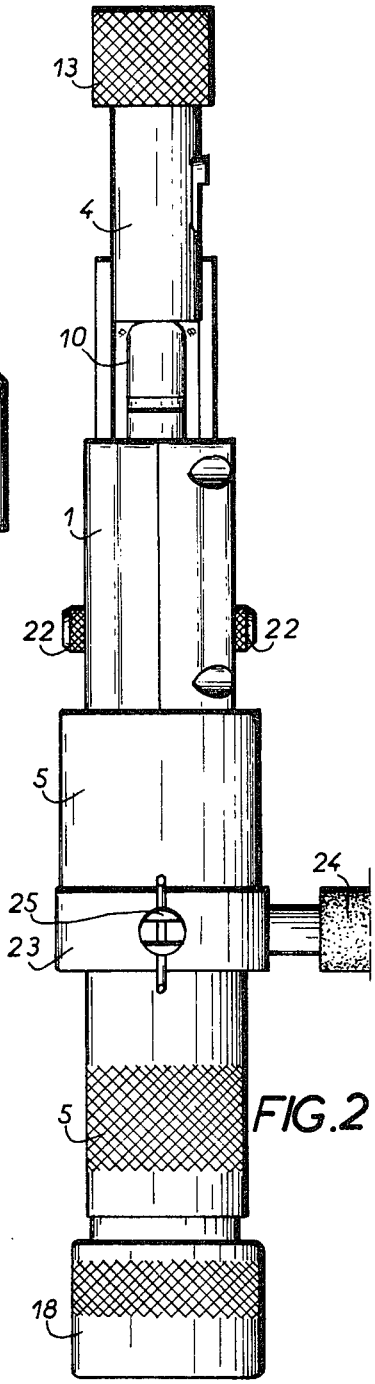
FIG. 2 is an external plan view corresponding to FIG. 1.

To secure the objects of the invention, without limiting the same except as defined in the claims, reference is made to the drawings, which illustrate a preferred embodiment.

The split frame 1 of the hammer carries a breech sleeve 4 and barrel sleeve 5, the latter two being connected by breech member 9, which has a flange $9^1$. Barrel sleeve 5 is screwed onto the front portion of the breech member 9, while breech sleeve 4 is pinned to the reduced diameter portion $9^2$ of the breech member 9, as can be seen in the drawing. On either side of the flange $9^1$, and within the split frame 1, are situated damping rings 2 and 3. A trigger *d* controls a camming member 6. Cartridges *c* are received from magazine 7, which is held in the grip by retainer 8.

It is evident that the feeding of cartridges can be achieved by completely different means, well known in the revolver and machine pistol art.

The shouldered breech member 9 permits, by the use of flange $9^1$, and the damping rings 2 and 3, a soft resilient positioning of the gun within the frame 1, thereby reducing recoil in the grip. The axial bore of the breech member 9 holds the cartridge *c* during firing.

The after end of the breech sleeve 4 has a cylindrical bore which receives the longitudinally movable cylindrical bolt 10, which carries a firing hammer mechanism 11 having at its front end $11^1$ a pin for hitting the percussion cap of the cartridge. The firing mechanism 11 includes a detent $11^2$ which cooperates with sear 12 and camming member 6, connected to the trigger.

The rear part of the bolt 10 is of reduced diameter and carries a rotatable thumb cocking piece 13, which is held in position by retainer 14. The inner part of retainer 14 allows the centering of a guiding rod 15 on which is strung a compression spring 16 which bears against firing hammer 11 and drives it against cartridge *c* when the sear 12 and detent $11^2$ are not engaged.

The rotatable thumb cocking piece has at its fore portion a threaded section $13^1$ which is screwed into the rear end of breech sleeve 4 in order to close and lock the bolt securely against the cartridge *c*, when the cartridge is to be fired.

These various parts, adequate for the proper operation of the pistol, are described only as an example, since they are well known in the technology. It is evident that completely different devices could be employed for cocking and locking the bolt.

The barrel sleeve 5 receives in its bore a piston 17, having an extreme rear end of greatly reduced diameter which forms a piston rod $17^1$ which slides in the bore $9^4$ (FIG. 5) of the fore part of breech member 9, which bore communicates in turn with the chamber $9^3$ in which cartridge *c* is fired.

Thereby the thrust exercised by the firing is applied axially to the piston rod $17^1$ of 17. The piston 17 is guided in its forward motion by flange $17^2$ while sliding inside barrel sleeve 5.

The piston 17 carries the reduced diameter impacting head $17^3$ at its fire end.

A cap 18 is screwed onto the front extremity of barrel sleeve 5. Cap 18 has a concentric axial bore $18^1$ which guides, during firing, the reduced diameter impact head $17^3$.

Resilient washer 19 is freely and slidably mounted on the reduced diameter impact head $17^3$ and inside barrel sleeve 5. The washer is deformed radially when it is compressed axially between cap 18 and flange $17^2$ as the impact head $17^3$ moves all the way forward. The forward motion of the impact head $17^3$ is stopped gently by the said compressing.

Moreover, washer 19 is designed to be supported and held for perfect alignment and tightness by use of a conical tip $19^1$ (FIG. 3) which corresponds in shape to the complemental recess $17^4$ in the front face of the cylindrical face of flange $17^2$.

Figure 5:
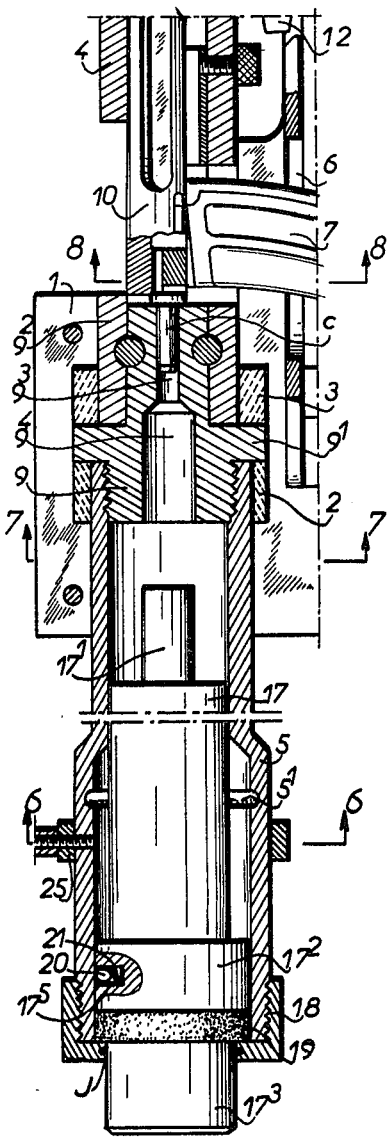
FIG. 5 is a partial longitudinal cross section of the hammer with the breech in a closed position and with the piston in its forward position.

Means for holding the piston 17 in retracted position, ready to be fired, include one or a plurality of detents. In FIG. 5 there is shown a ball detent 20 sliding loosely in hole $17^5$ in flange $17^2$. The ball detent 20 is spring biased radially outwardly by compression spring 21. The ball detent, under the elastic pressure of compression spring 21, cooperates with the circular groove $5^1$ in the inner wall of barrel sleeve 5.

It will thus be evident that the ball detent 20 holds the piston 17 in its rearward position, against unintended forward motion caused by ordinary handling of the explosive-cartridge powered hammer, until such time as the trigger *d* is squeezed to fire the cartridge *c*. To achieve this result the compression spring 21 is of such size as to exert a suitable outward force on ball 20.

Figures 3, 4:
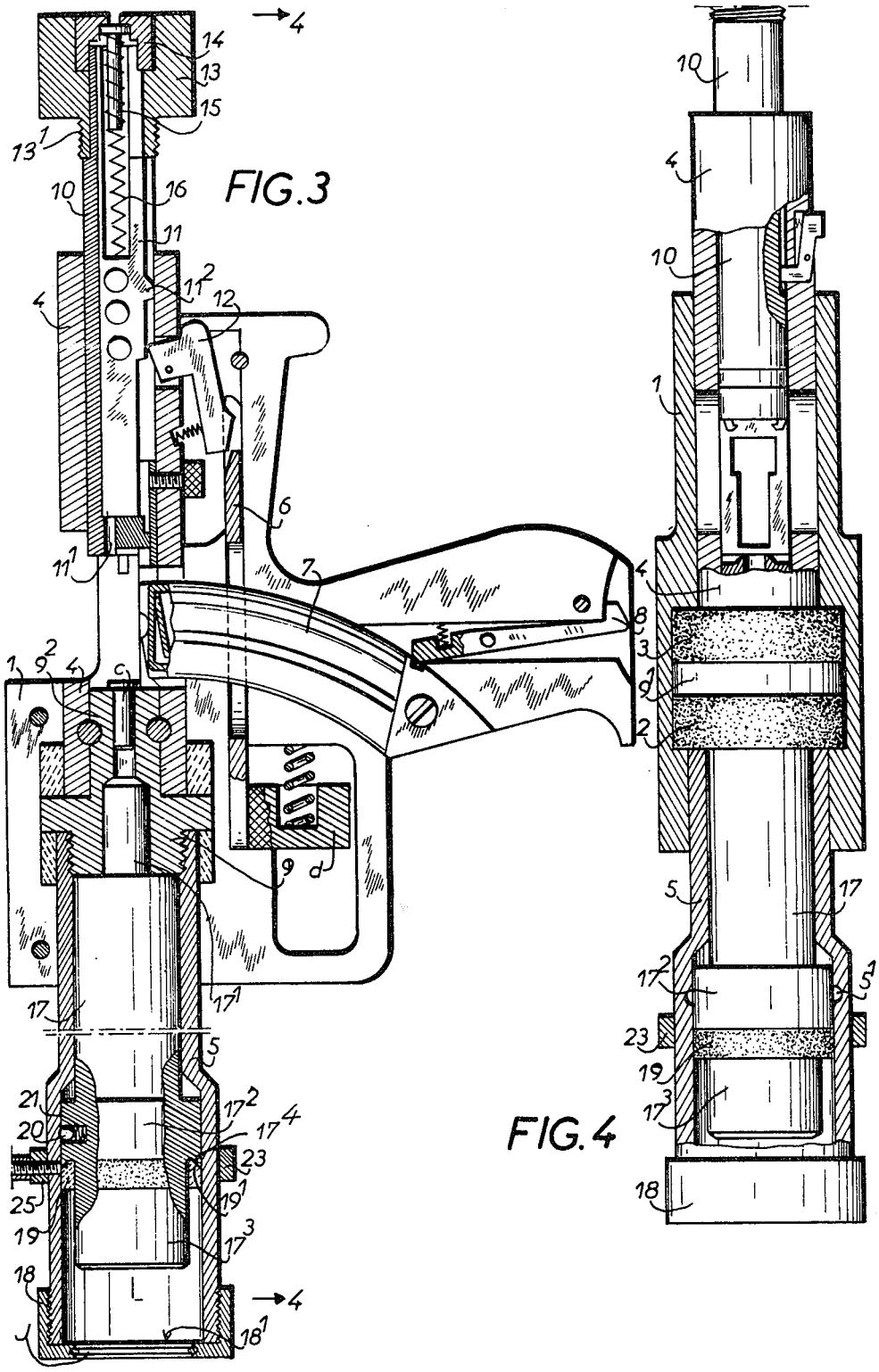
FIG. 3 is a longitudinal sectional view of the hammer with the breech in the open position and with the piston in its rearward position.
FIG. 4 is a longitudinal sectional plan view along the line 4—4 of FIG. 3.

As illustrated in FIG. 3 of the drawing, the axial opening $18^1$ of cap 18 is provided with a seal J, which cooperates with the outer surface of the reduced diameter impact head $17^3$ to form an air tight chamber when the cartridge *c* is fired. At that time, the air in the chamber is compressed. After the impact head $17^3$ has struck its blow, the compressed air reexpands and drives the impact head $17^3$ back to a retracted position.

The withdrawal of hammer 17 to its retracted position can also be accomplished by rebound of the impact head $17^3$ from the workpiece or by manually pushing the protruding impact head $17^3$.

Other suitable means can be used to retract the impact head $17^3$, such as spring means, means powered by the gases from the spent cartridge *c* or by the use of compressed air supplied from an air line.

Figure 6:
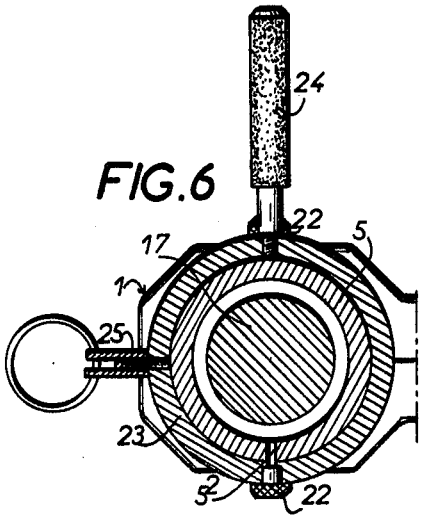
FIG. 6 is a cross-sectional profile view along the line 6—6 of FIG. 5.

Release of trapped air or the burnt gases from the cartridge *c* is accomplished by the vent hole $5^2$ (FIG. 6) in the front section of the barrel sleeve 5, and by the vent holes $5^3$ and $5^4$ in the rear section of the barrel sleeve. Each vent hole $5^2$, $5^3$ and $5^4$ is provided with a silencer 22 for the escape of the air or the gases.

Figure 8:
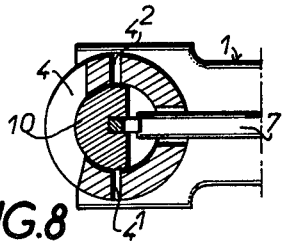
FIG. 8 is a cross-sectional view along the line 8—8 of FIG. 5.
Figure 7:
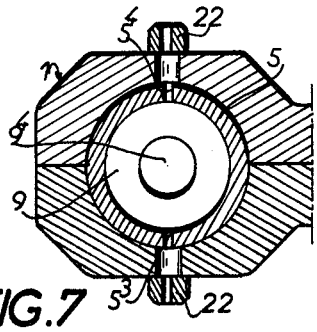
FIG. 7 is a side view in cross-section along the line 7—7 of FIG. 5.

As illustrated in FIG. 8, the breech sleeve 4 is provided with two safety vents $4^1$ and $4^2$.

It is to be noted that a supporting collar 23 is removably mounted on the barrel sleeve 5 to allow the attachment of a handle 24 and a suspension ring 25.

In the illustrated example, the piston 17 has a reduced diameter immediately behind the flange $17^2$. Without departing from the invention, the diameter of that portion of piston 17 could be increased to the diameter of the flange $17^2$, with corresponding increase of size of part of the barrel sleeve 5. This would increase the weight of the piston 17 and increase the force of the blow.

It is evident that this explosive-cartridge powered hammer or impact tool may be utilized in other procedures where a blow by a hammer is sought. For example: in riveting operations, or for the breaking up of work pieces by applying blows.

The advantages can be noted from the description while particularly emphasizing:

the simplicity of the construction, extreme force of the blow.

The invention is not limited to the specific form just described, but is defined by the following claims:

We claim:

1. An explosive-cartridge powered hammer or impact tool comprising:

a breech member adapted to receive an explosive-cartridge;

means to lock said explosive-cartridge in said breech member and to fire said explosive-cartridge;

grip means;

resilient means connecting said grip means to said breech member, said resilient means comprising means permitting and guiding said breech member to slide smoothly back and forth with respect to said grip means in a direction parallel to the axis of said breech means, a pair of damping rings, each defining one of the limits of travel of said breech member and each returning said breech member away from said limit of travel, when said breech member is forced towards said limit of travel;

whereby said grip means resiliently supports said breech member;

a barrel sleeve fastened to the breech member, so as to receive in its bore the burning gases from the explosive-cartridge when said explosive-cartridge is fired;

piston means slidable in the bore of said barrel sleeve in gas-tight relationship, whereby, when said explosive-cartridge is fired, the piston is driven by the burning gases from a rearward position forward along the bore of said barrel sleeve to a forward position;

an impact head carried by the fore end of said piston for impacting on an impact-receiver;

said impact head protruding beyond said barrel sleeve during impact;

means to retract said piston to its rearward position, said means comprising sealed expandable-compressible chamber means formed between said piston and said bore, said chamber means decreasing in volume as said piston is driven to its forward position, whereby air therein is compressed and tends to drive said piston back to its rearward position; and detent means to retain said piston in its rearward position until an explosive-cartridge is fired.

2. Subject matter according to Claim 1 wherein:

said impact head is a cylinder of lesser diameter than said piston, whereby a radial shoulder joins said lesser diameter impact head to the said fore end of said piston;

a cap covering the fore end of said barrel sleeve, said cap having therein an aperture closely fitting the lesser diameter of said impact head;

whereby, when said explosive-cartridge is fired and the impact head advances to protrude beyond the fore end of the barrel, air is trapped in the annular space defined by the outside of the lesser diameter impact head, the inside bore of the barrel sleeve, said radial shoulder and the inside of said cap;

whereby air is compressed in said annular space as the impact head completes its forward stroke; and whereby said compressed air is effective to return said piston to its rearward position when said forward stroke is completed.

3. Subject matter according to Claim 2 having:

a resilient gasket adjacent said radial shoulder, spanning the radial space between the outside of said lesser diameter impact head and the inside bore of the said barrel sleeve, and adapted to be compressed against said cap upon extreme forward motion of said piston.

4. Subject matter under Claim 3 in which:

said gasket has a face, adjacent said shoulder, which is conically tapered and said shoulder has a complementary interfitting conical taper;

said taper slanting in such a direction as to compress said gasket radially inward upon forward motion of said piston.

5. Subject matter under claim 2 having:

a seal at the edge of the aperture in said cap, said seal adapted to prevent escape of air between the edge of the aperture in said cap and the movable impact head.

6. Subject matter according to claim 1 in which:

said detent means includes a ball, retained loosely in a hole, and spring biased outwardly against a sliding surface, and a shallow recess in said surface for releasably catching said ball.

7. Subject matter under claim 6 in which:

said ball detent is located in said piston and said recess is located in the bore of said barrel sleeve.

8. Subject matter under claim 2 in which:

said barrel is provided with a vent hole for release of air displaced from the barrel sleeve when the piston is returned from its forward position to its rearward position.

9. Subject matter under claim 1 in which:

said barrel sleeve is provided with a vent hole for releasing burnt gases.

10. Subject matter under claim 9 in which said vent hole is provided with a silencer.

11. Subject matter under claim 1 in which said barrel is provided with a supporting collar;

said supporting collar carrying a handle;

said supporting collar carrying a supporting ring;

whereby said explosive-cartridge powered hammer or impact tool can be lifted by said handle or by said supporting ring.

12. An explosive-cartridge powered hammer or impact tool comprising:

a breech member having a chamber for receiving an explosive cartridge;

said chamber opening forwardly and coaxially to a larger bore having a first diameter;

a barrel sleeve of a second diameter, larger than said first diameter, fastened coaxially to the fore end of said breech member;

a piston having a smaller diameter portion closely fitting and filling said larger bore of said first diameter when said piston is in its rearward position;

said piston having coaxially therewith a larger portion closely fitting and filling said barrel sleeve when said piston is in its rearward position;

whereby, when said cartridge is fired, the initial high pressure of the gases of the explosion is effective only over an area defined by the said first diameter, and when said piston has moved forward so that said smaller diameter portion of said piston has left said larger bore of said first diameter, the then reduced pressure of the now partly expanded gases from the explosion are effective over a total area defined by said larger second diameter.

* * * * *